US009352560B2

(12) United States Patent
Taylor et al.

(10) Patent No.: US 9,352,560 B2
(45) Date of Patent: May 31, 2016

(54) PRINTHEAD STRUCTURE

(71) Applicant: HEWLETT-PACKARD DEVELOPMENT COMPANY, L.P., Houston, TX (US)

(72) Inventors: Mark Sanders Taylor, Monmouth, OR (US); Craig Olbrich, Corvallis, OR (US); Byron K. Davis, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/890,494

(22) PCT Filed: Jun. 28, 2013

(86) PCT No.: PCT/US2013/048676
§ 371 (c)(1),
(2) Date: Nov. 11, 2015

(87) PCT Pub. No.: WO2014/209379
PCT Pub. Date: Dec. 31, 2014

(65) Prior Publication Data

US 2016/0107442 A1 Apr. 21, 2016

(51) Int. Cl.

| | |
|---|---|
| ***B41J 2/15*** | (2006.01) |
| ***B41J 2/145*** | (2006.01) |
| ***B41J 2/05*** | (2006.01) |
| *B41J 3/60* | (2006.01) |
| *B41J 2/14* | (2006.01) |

(52) U.S. Cl.
CPC .. *B41J 2/05* (2013.01); *B41J 2/145* (2013.01); *B41J 2/1404* (2013.01); *B41J 3/60* (2013.01); *B41J 2002/14475* (2013.01)

(58) Field of Classification Search
None
See application file for complete search history.

(56) References Cited

U.S. PATENT DOCUMENTS

| | | | | |
|---|---|---|---|---|
| 6,106,096 | A | 8/2000 | Komplin et al. | |
| 6,360,439 | B1 | 3/2002 | Cleland et al. | |
| 6,799,831 | B2 | 10/2004 | Inamoto et al. | |
| 6,971,171 | B2 | 12/2005 | Komuro et al. | |
| 7,485,412 | B2 | 2/2009 | Okano et al. | |
| 7,891,780 | B2 | 2/2011 | Ueda | |
| 7,914,127 | B2 | 3/2011 | Martina et al. | |
| 2007/0064060 | A1 | 3/2007 | Gu et al. | |
| 2009/0102887 | A1 | 4/2009 | Eguchi et al. | |
| 2011/0063361 | A1 | 3/2011 | Clampini et al. | |
| 2013/0027466 | A1 | 1/2013 | Petruchik et al. | |
| 2014/0036003 | A1* | 2/2014 | Brust | B41J 2/1404 347/61 |

OTHER PUBLICATIONS

Aden, J.S. et al.; The Third-Generation HP Thermal InkJet Printhead; http://www.hpl.hp.com/hpjournal/94feb/feb94a6.pdf >; Feb. 1994.

* cited by examiner

*Primary Examiner* — Lisa M Solomon
(74) *Attorney, Agent, or Firm* — HP Inc. Patent Department

(57) ABSTRACT

In one example, a printhead structure includes: a first layer; an array of openings in the first layer to form printing fluid ejection chambers; a second layer on the first layer; an array of orifices through the second layer, each orifice located adjacent to one of the openings in the first layer; a groove in the first layer spanning substantially a full length of the array of openings; and multiple holes through the second layer to the groove in the first layer.

17 Claims, 6 Drawing Sheets

PRINTHEAD STRUCTURE

BACKGROUND

Inkjet printheads are composite integrated circuit devices in which polymers and other materials are layered together during fabrication. Polymers are often used in inkjet printheads to form fluidic structures and as adhesives and encapsulants.

DRAWINGS

Figure 1:
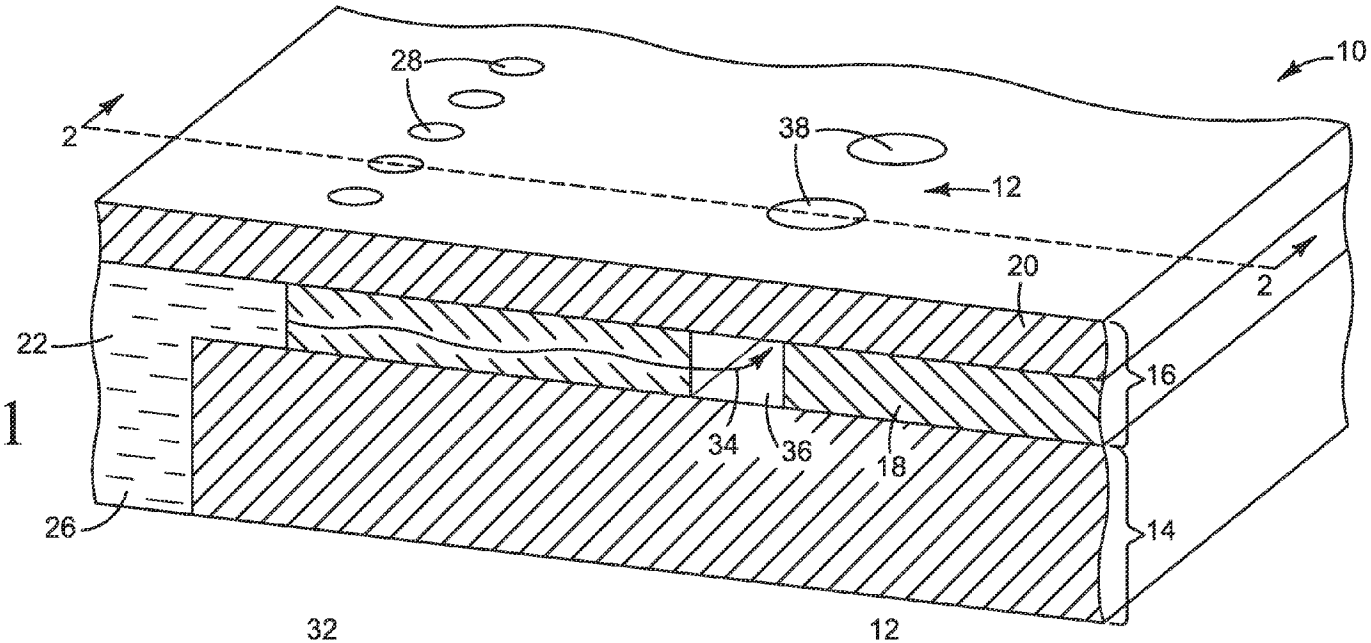
Figure 2:
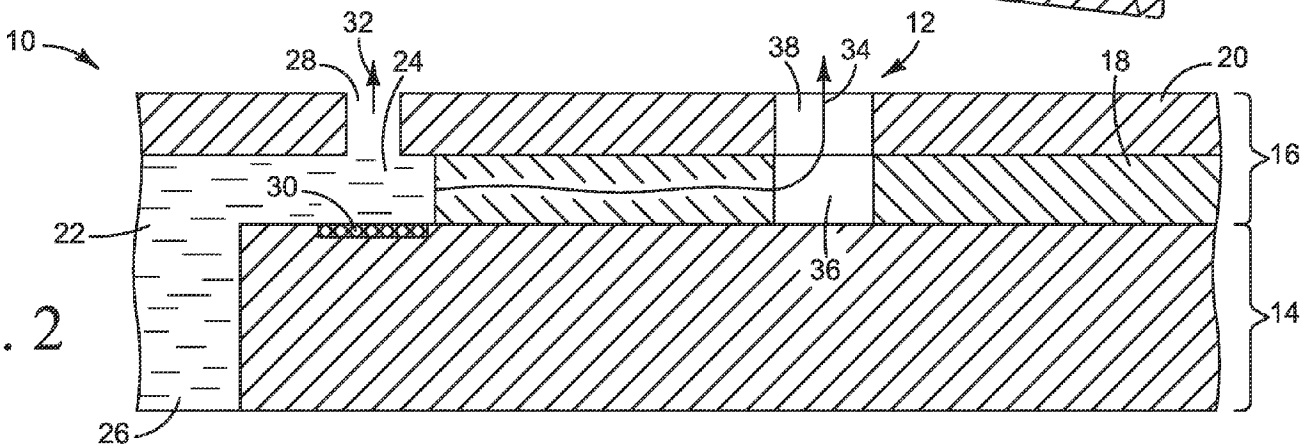

FIGS. 1 and 2 illustrate one example of a new "anti-swelling" printhead structure to help reduce swelling due to ink diffusion.

FIG. 3, FIGS. 4-5, FIG. 6, and FIG. 7 illustrate other examples of a new anti-swelling printhead structure.

The same part numbers designate the same or similar parts throughout the figures. The figures are not necessarily to scale. The relative size of some parts is exaggerated for clarity.

DESCRIPTION

Polymers are often used in inkjet printheads to form structures that are exposed to the ink contained in the printhead. Ink can diffuse into surrounding polymer structures, causing the affected material to swell. Swelling can create significant interfacial stresses that de-laminate layer(s) of material in the printhead. Such delamination, often visible as blistering, can compromise the fluidic and mechanical integrity of the printhead and degrade print quality.

A new anti-swelling printhead structure has been developed to help reduce swelling and blistering due to ink diffusion. In one example, the anti-swelling structure includes a channel through an interior layer and multiple vent holes to the channel through an exterior layer covering the channel. The channel extends along substantially the full extent of the orifice array to interrupt the diffusion of ink through the interior layer and to collect and channel the ink to the vent holes where the ink escapes the channel into the atmosphere. It has been shown that an interior channel is sufficient to interrupt the diffusion of ink to reduce swelling and that exterior holes effectively vent ink from the channel. Perforating the exterior layer with vent holes, rather than cutting it with channels, helps preserve structural integrity while still controlling swelling.

This and other examples shown in the figures and described below illustrate but do not limit the invention, which is defined in the Claims following this Description.

FIGS. 1 and 2 illustrate part of a printhead 10 implementing one example of a new structure 12 that helps reduce swelling due to ink diffusion. For convenience, structure 12 is sometimes referred to herein as "anti-swelling" structure 12. FIG. 2 is a section view taken along the line 2-2 in FIG. 1. FIGS. 1 and 2 depict an idealized representation of a printhead 10 to better illustrate "anti-swelling" structure 12. An actual inkjet printhead 10 is a typically complex integrated circuit (IC) structure with layers and elements not shown in FIGS. 1 and 2.

Referring to FIGS. 1 and 2, printhead 10 is formed in part in a layered architecture that includes an IC structure 14 and an orifice plate 16. In the example shown, orifice plate 16 includes two layers—an interior layer 18 and an exterior layer 20. Ink or other printing fluid 22 is supplied to an ejection chamber 24 through an inlet 26. Fluid 22 is ejected from chamber 24 through orifices 28 in orifice plate outer layer 20 at the urging of an ejector 30 formed on IC structure 14, as indicated by arrow 32 in FIG. 2. (Printhead orifices 28 are also commonly referred to as nozzles.) In a thermal inkjet printhead, for example, a resistor 30 is selectively energized to heat fluid 22 in chamber 24 to force a drop of ink out of orifice 28. Piezoelectric or other ejectors 30 are possible.

Orifice plate interior layer 18 is sometimes called the "chamber layer" because this layer forms the walls surrounding ejection chambers 24. Orifice plate exterior layer 20 is sometimes called the "orifice layer" because orifices 28 are formed in this layer. In some printheads 10, chamber layer 18 is made of an adhesive or other polymer that is permeable to ink 22 while orifice layer 20, made of metal or polyimide and other highly cured polymers, is impermeable to ink 22. "Impermeable" as used in this document means layer 20 is sufficiently less permeable to the ink or other printing fluid than layer 18 so that ink or other printing fluid 22 in ejection chamber 24 diffuses primarily into chamber layer 18 and only secondarily (or not at all) into orifice layer 20, as indicated by a wavy line 34 in FIGS. 1 and 2.

Anti-swelling structure 12 includes a channel 36 in chamber layer 18 and vents 38 in orifice layer 20. In the example shown, channel 36 is configured as a groove through the full thickness of chamber layer 18 extending parallel to the line of orifices 28, and vents 38 are configured as holes through orifice layer 20 to groove 36. The diffusion of fluid 22 from ejection chambers 24 into and through chamber layer 18 is interrupted by groove 36. Fluid from chamber layer 18 that reaches groove 36 is channeled to holes 34 where it is vented to the atmosphere. Fluid 22 diffusing into chamber layer 18 reaches groove 36 primarily in the form of vapor that immediately escapes into the atmosphere through vent holes 34. The diffusion rate through polymers commonly used to form chamber layer 36, about 10e-8 μm/sec, is much lower than the rate of evaporation through vent holes 34 so that no liquid forms or accumulates in groove 36. Although structure 12 vents fluid away from chamber layer 18 to reduce swelling, groove 36 and holes 38 also provide space to absorb any swelling in layers 18 and 20 to help relieve interfacial stresses that can cause blistering. Thus, structure 12 functions both to reduce swelling and to relieve stress caused by swelling.

Figure 3:
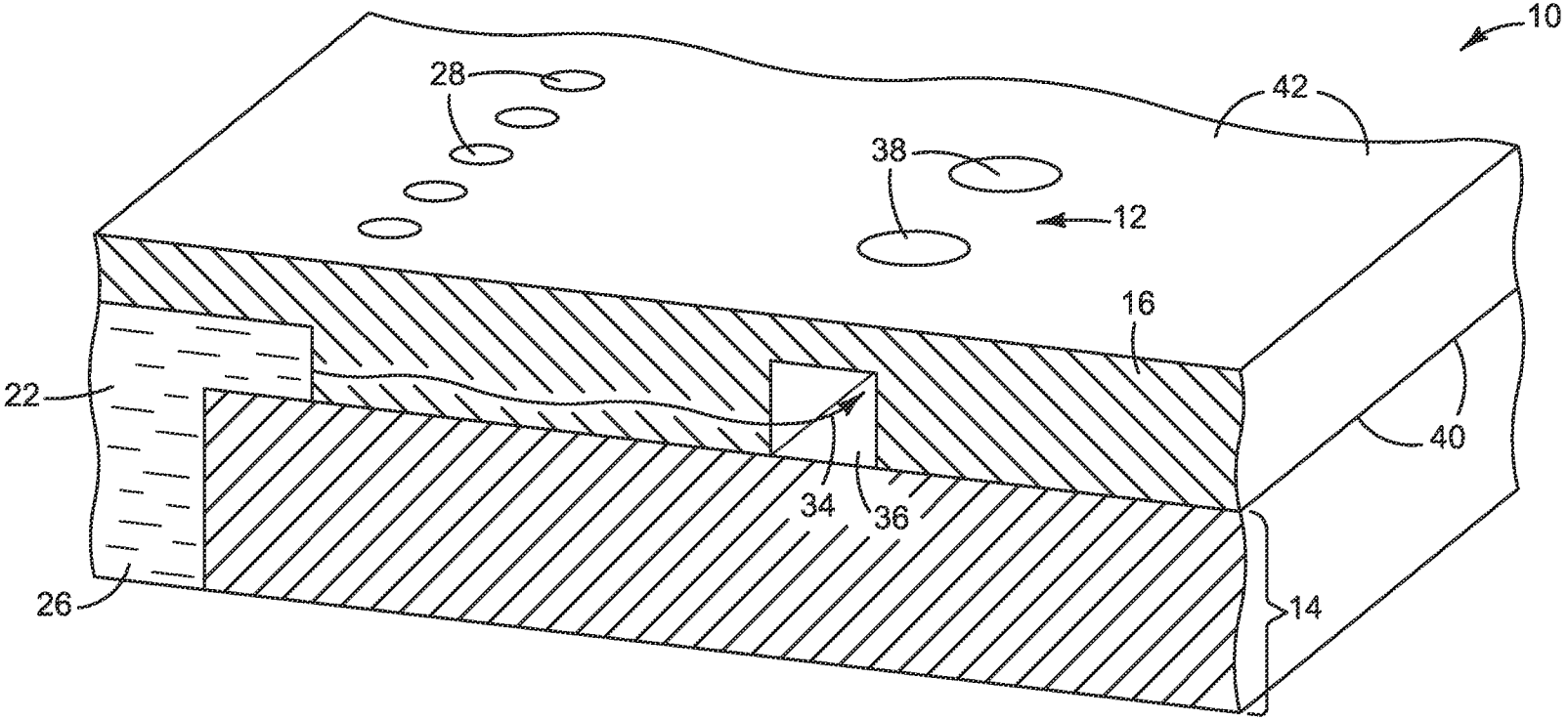

In the example shown in FIG. 3, printhead 10 includes a single layer orifice plate 16 with an anti-swelling structure 12 in which channel 32 is formed as a groove in the back side 40 of orifice plate 16 and vents 38 are formed as holes through the front side 42 of orifice plate 16 to groove 36. The depth of groove 36 may be changed by adjusting a single processing step to achieve the desired volume and/or profile for groove 36, for example to a profile in which groove 36 is deeper than the ejection chamber is high, as shown in FIG. 3.

Figure 4:
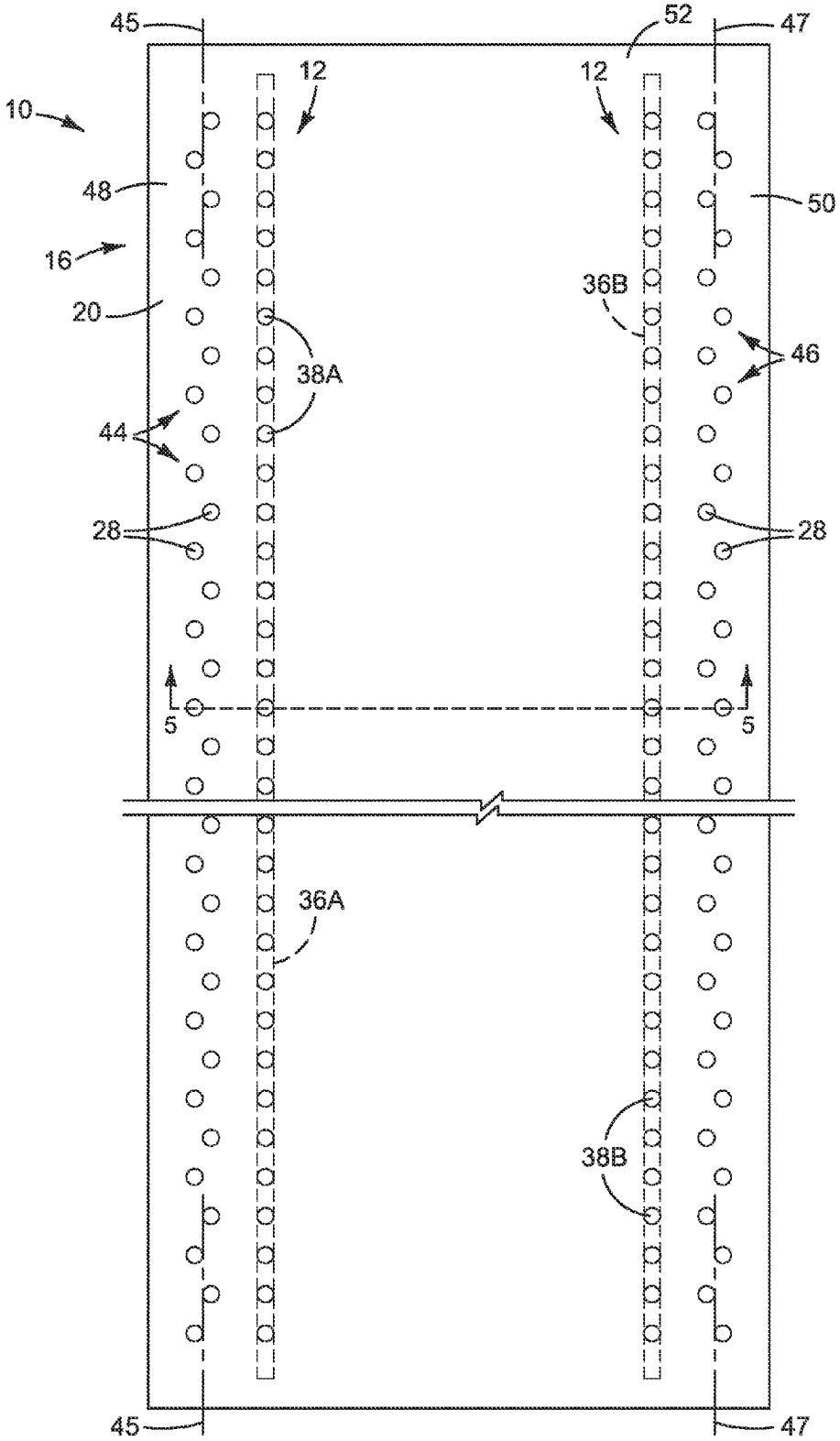
Figure 5:
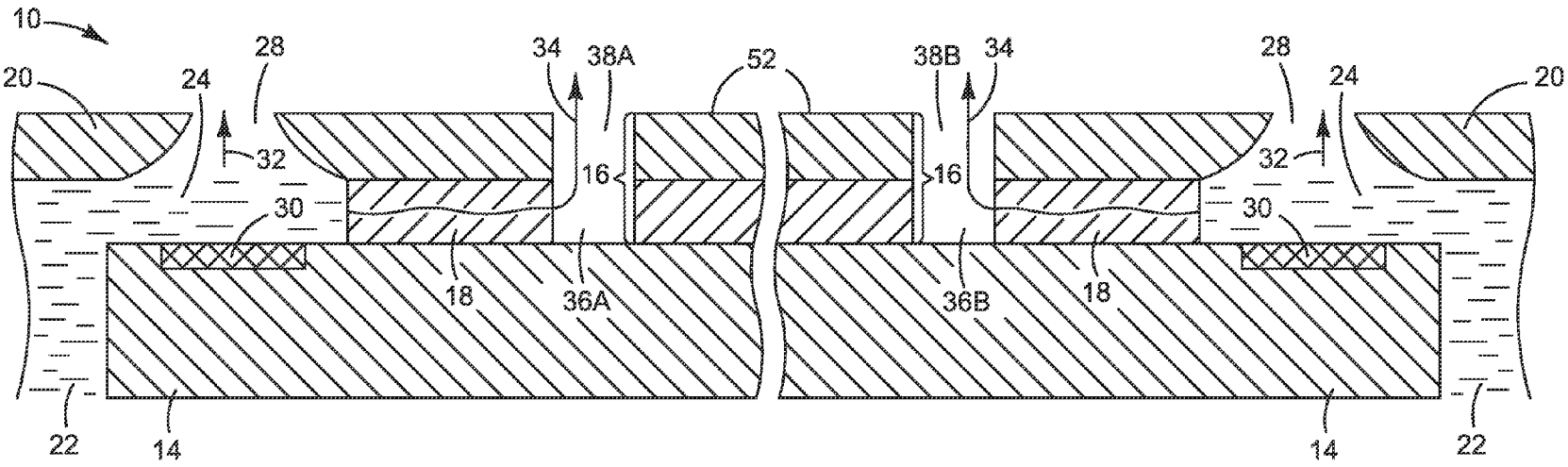

FIG. 4 is a plan view of a printhead 10 implementing another example of an anti-swelling structure 12. FIG. 5 is a section view taken along the line 5-5 in FIG. 4. Referring to FIGS. 4 and 5, printhead 10 includes two arrays 44, 46 of orifices 28. The orifices 28 in each array 44, 46 are arranged along a line 45, 47 lengthwise on each side 48, 50 of printhead 10. In this example, anti-swelling structure 12 includes two continuous grooves 36A, 36B in chamber layer 18 and vent holes 38A, 38B in orifice layer 20. First groove 36A extends parallel to and spans the full length of first orifice array 44. Second groove 36B extends parallel to and spans the full length of second orifice array 46. Both grooves 36A and 36B are located inboard of arrays 44, 46 to prevent fluid 22 from diffusing into the bulk of chamber layer 18 between grooves 36A, 36B along the center part 52 of printhead 10.

In the example of anti-swelling structure 12 shown in FIGS. 1 and 2, vent holes 38 are larger and more loosely spaced than ejection orifices 28. In the example shown in FIGS. 4 and 5, vent holes 38 are the same size and spacing as orifices 28. In both examples, the diameter of each vent hole 38 is the same as the width of the corresponding groove 36. However, other suitable configurations are possible. For a typical thermal inkjet printhead for printing solvent based inks with 20-40 μm ejection orifices 28, testing indicates that an anti-swelling structure 12 with the following configuration will be effective to interrupt the diffusion of ink through the orifice plate, to control swelling and significantly reduce blistering:

a barrier channel 36 that is 15-70 μm wide, through the full thickness of chamber layer 18 (or at least to the height of ejection chamber 24 in a single layer orifice plate), and spaced 200-600 μm from the orifice array;

vent holes 38 that are 15-150 μm in diameter (or wide if not circular); and evenly spaced vent holes 38 covering at least 10% of the area of the corresponding channel 36.

For the configuration noted above, the effective range of venting area is not significantly greater than the total area of ejection orifices. Accordingly, the use of vent holes 38 in orifice layer 20 helps preserve the structural integrity of orifice plate 16 compared to grooves or other elongated openings, while still reducing or eliminating damage from swelling. Also, it is expected that these same configurations will be effective to reduce or eliminate blistering due to swelling in the orifice plate for other fluids and for other inkjet printhead applications.

Figure 6:
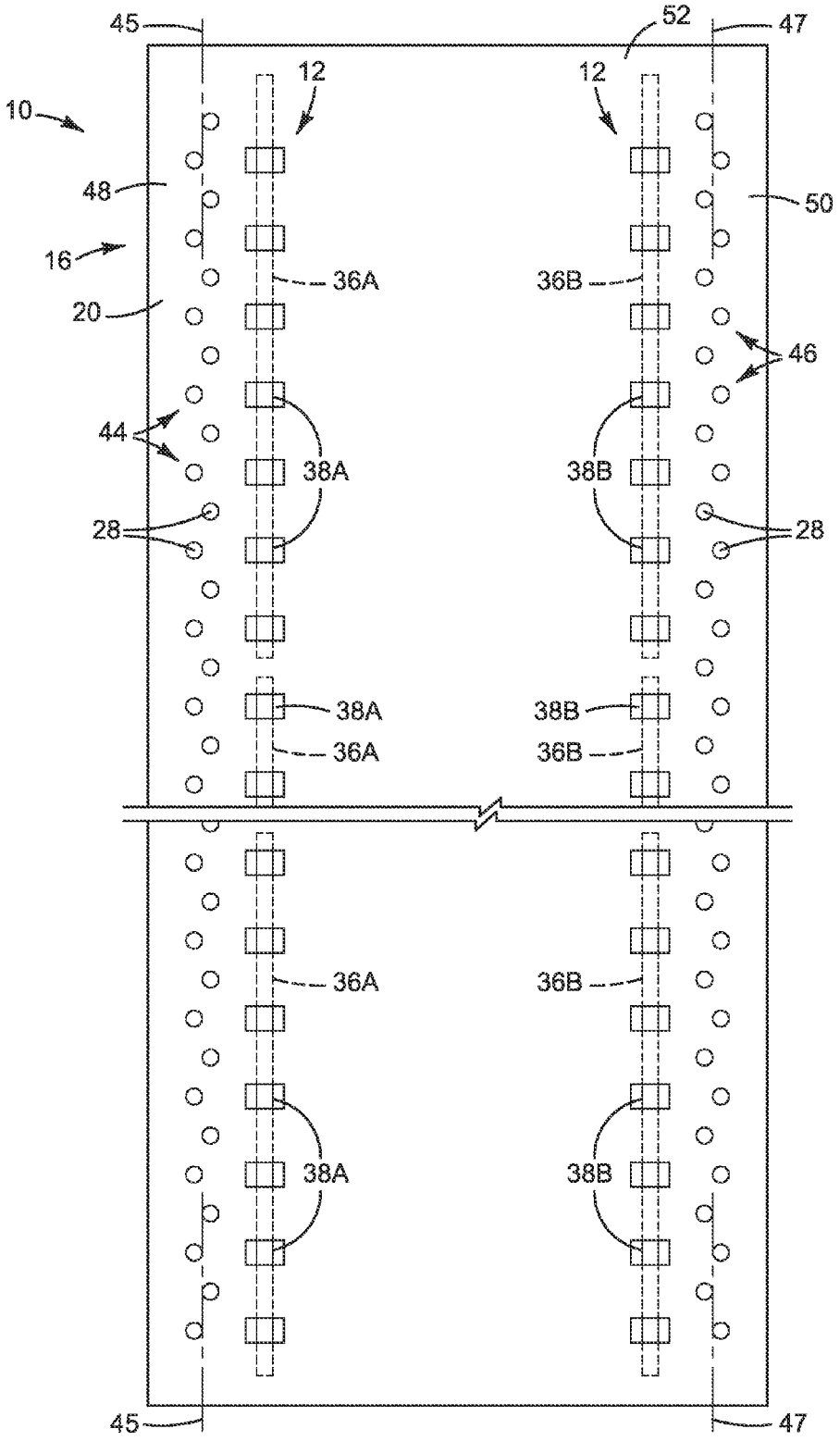

In the example of anti-swelling structure 12 shown in FIG. 6, multiple grooves 36A, 36B are arranged along each orifice array and together span substantially the full length of each respective orifice array 44, 46. Larger, rectangular vent holes 38A, 38B are more loosely spaced along grooves 36A, 36B compared the smaller more tightly spaced round vent holes in the example shown in FIGS. 4 and 5. While discontinuous multiple grooves may be suitable for some implementations of an anti-swelling printhead structure 12, for example to optimize stresses in the materials, the discontinuities must be sufficiently small or the grooves arranged to still prevent a damaging level of ink diffusion through chamber layer 18. For a single line of grooves such as grooves 36A, 36B shown in FIG. 6, it is expected that the grooves will need to cover at least 50% of the full length of the line of orifices to prevent a damaging level of ink diffusion.

Figure 7:
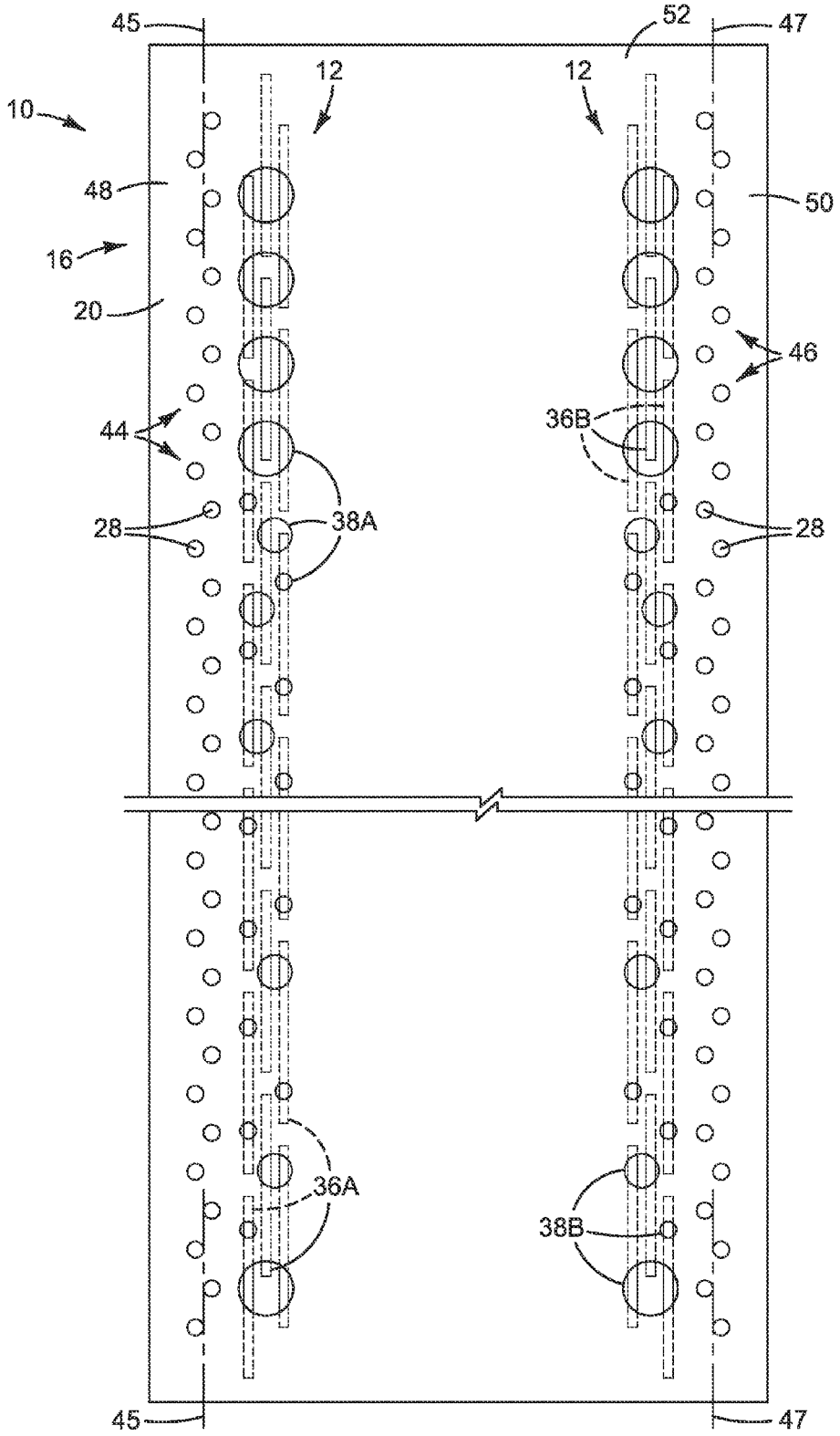

In the example of anti-swelling structure 12 shown in FIG. 7, multiple grooves 36A, 36B are arranged in a staggered configuration in which each groove overlaps another groove along the full length of the respective orifice array 44, 46. Also, in this example, an array of different size holes 38A, 38B are used to vent grooves 36A, 36B. The size and arrangement of vent holes 38A, 38B may be varied to help optimize stresses in layers 18 and 20 to extend the useful life of printhead 10. Overlapping multiple grooves along each orifice array lengthens the path diffusing ink must take to reach the bulk of chamber layer 18 at the center part 52 of printhead 10. The longer diffusion path slows any swelling in chamber layer 18 that may be caused by ink diffusing past the vented grooves 36A, 36B to help further extend the useful life of printhead 10.

As noted at the beginning of this Description, the examples shown in the figures and described above illustrate but do not limit the invention. Other examples are possible. For instance, serpentine or stepped channels may be desirable in some implementations rather than straight channels. Accordingly, the foregoing description should not be construed to limit the scope of the invention, which is defined in the following claims.

What is claimed is:

1. A printhead structure, comprising:

a first layer;

an array of openings in the first layer to form printing fluid ejection chambers;

a second layer on the first layer;

an array of orifices through the second layer, each orifice located adjacent to one of the openings in the first layer;

a groove in the first layer spanning substantially a full length of the array of openings; and multiple holes through the second layer to the groove in the first layer.

2. The printhead structure of claim 1, wherein the first layer is permeable to a printing fluid and the second layer is impermeable to the printing fluid.

3. The printhead structure of claim 2, wherein the openings in the first layer are arrayed along a line and the groove extends parallel to the line continuously along the full length of the orifice array.

4. The printhead structure of claim 2, wherein the openings in the first layer are arrayed along a line and the groove includes multiple grooves covering at least 50% of the full length of the orifice array.

5. The printhead structure of claim 4, wherein the grooves are arranged in a staggered configuration in which each groove overlaps another groove and the arrangement of grooves covers the full length of the orifice array.

6. The printhead structure of claim 3, wherein:

the array of openings in the first layer includes a first array of openings arrayed along a first line and a second array of openings arrayed along a second line parallel to the first line; and the groove includes two grooves between the first and second arrays of openings, each of the two grooves extending parallel to the first and second lines continuously along the full length of the orifice arrays.

7. The printhead structure of claim 1, wherein the holes through the second layer are evenly spaced and cover at least 10% of an area of the groove.

8. The printhead structure of claim 7, wherein the groove is 200-600 μm from the orifices.

9. The printhead structure of claim 8, wherein:

the orifices are 20-40 μm in diameter;

the groove is 15-70 μm wide; and each hole is 15-150 μm in diameter.

10. A printhead, comprising:

multiple printing fluid ejectors;

a fluid chamber near each ejector;

multiple orifices through which printing fluid may be ejected from the chambers, the orifices formed in an orifice plate that partially defines the chambers; and a channel in the orifice plate and multiple vents in the orifice plate connected to the channel, the channel configured to interrupt the diffusion of printing fluid away from each chamber into the orifice plate and to channel the printing fluid to the vents through which the fluid may pass from the channel into the atmosphere.

11. The printhead of claim 10, wherein the fluid chambers are arranged along a line and the channel extends parallel to the line continuously along the full length of the line of chambers.

12. The printhead of claim 10, wherein:

the orifice plate includes an interior layer at least partially surrounding each chamber and an exterior layer covering the interior layer, the interior layer permeable to a the printing fluid and the exterior layer impermeable to the printing fluid;

each orifice extending through the exterior layer to one of the chambers;

the channel comprising a groove in the interior layer; and each vent comprising a hole extending through the exterior layer to the groove in the interior layer.

13. The printhead of claim 12, wherein the groove extends completely through the thickness of the interior layer.

14. The printhead of claim 10, wherein the orifice plate includes only one layer, the channel comprises a groove in one side of the one layer and each vent comprises a hole from the other side of the one layer to the groove.

15. A printhead, comprising:

a substrate including multiple printing fluid ejectors;

an orifice layer including multiple orifices each associated with one or more of the ejectors such that printing fluid may be dispensed through the orifices at the urging of the ejectors, the orifice layer affixed to the substrate with a layer of polymer adhesive; and a vented barrier within the adhesive layer to simultaneously block the spread of printing fluid through the adhesive layer and vent printing fluid from the adhesive layer to the atmosphere.

16. The printhead structure of claim 15, wherein the vented barrier comprises an air gap in the adhesive layer.

17. The printhead structure of claim 14, wherein the orifices are arrayed lengthwise along the orifice layer and the air gap includes a continuous vented groove in the adhesive layer spanning a full length of the array of orifices.

* * * * *